United States Patent [19]

Diamantoglou et al.

[11] Patent Number: 4,734,239

[45] Date of Patent: Mar. 29, 1988

[54] PROCESS FOR THE PRODUCTION OF WATER-INSOLUBLE FIBERS OF CELLULOSE MONOESTERS OF MALEIC ACID, SUCCINIC ACID AND PHTHALIC ACID, HAVING AN EXTREMELY HIGH ABSORBABILITY FOR WATER AND PHYSIOLOGICAL LIQUIDS

[75] Inventors: Michael Diamantoglou, Erlenbach; Gerhard Meyer, Obernburg, both of Fed. Rep. of Germany

[73] Assignee: Akzo NV, Arnheim, Netherlands

[21] Appl. No.: 837,311

[22] Filed: Mar. 3, 1986

Related U.S. Application Data

[63] Continuation of Ser. No. 597,104, Apr. 2, 1984, abandoned.

[30] Foreign Application Priority Data

Apr. 2, 1983 [DE] Fed. Rep. of Germany ..... 3312022

[51] Int. Cl.[4] ..... D01F 2/02

[52] U.S. Cl. ..... 264/187; 106/163.1; 106/169; 106/198; 536/63; 264/211.16

[58] Field of Search ..... 264/187, 200, 207, 211.14, 264/211.16; 536/63, 84; 106/163.1, 169, 203, 198

[56] References Cited

U.S. PATENT DOCUMENTS

| | | | |
|---|---|---|---|
| 2,053,768 | 9/1936 | Dreyfus | 536/63 |
| 2,069,974 | 2/1937 | Schulze | 536/63 |
| 2,093,464 | 9/1937 | Malm et al. | 536/63 |
| 2,265,916 | 12/1941 | Lilienfeld et al. | 264/187 |
| 2,495,767 | 1/1950 | Reid et al. | 264/187 |
| 2,853,485 | 9/1958 | Werner et al. | 536/63 |
| 3,671,184 | 6/1972 | Cuculo | 536/63 |
| 4,059,457 | 11/1977 | Austin | 106/203 |
| 4,278,790 | 7/1981 | McCormick | 106/163.1 |
| 4,302,252 | 11/1981 | Turbak et al. | 264/187 |

FOREIGN PATENT DOCUMENTS

| | | | |
|---|---|---|---|
| 0027033 | 4/1981 | European Pat. Off. . | |
| 0457031 | 11/1936 | United Kingdom | 264/187 |
| 0535900 | 4/1941 | United Kingdom | 264/187 |

*Primary Examiner*—Jan H. Silbaugh
*Assistant Examiner*—Hubert C. Lorin
*Attorney, Agent, or Firm*—Michael J. Striker

[57] ABSTRACT

Water-insoluble fibers of cellulose monoester of maleic acid, succinic acid, or phthalic acid having an extremely high absorption ability for water and physiological liquids are produced by (a) preparing at 20° to 80° C. a solution of activated cellulose in dimethylacetamide or 1-methyl-2-pyrrolidon containing 5 to 30% by weight activated cellulose of an average degree of polymerization from 300 to 800 and 3 to 20% by weight LiCl, (b) reacting the solution with a corresponding carboxylic acid anhydride in a mol ratio from 1:0.20 to 1:4 at 20° to 120° C. in the presence of known esterification catalyst until a degree of esterification from 0.1 to 1.7, (c) wet-spinning the cellulose monoester solution into a coagulation agent, with or without (d) converting the fibers of cellulose monoester of phthalic acid and, if necessary, the of cellulose monoester of maleic acid or succinic acid, in a substantially organic solvent by means of reaction with alkali metal hydroxide, alkali metal alcoholate, ammonia, primary or secondary amines, partially or completely into fiber-shaped salts.

11 Claims, No Drawings

PROCESS FOR THE PRODUCTION OF WATER-INSOLUBLE FIBERS OF CELLULOSE MONOESTERS OF MALEIC ACID, SUCCINIC ACID AND PHTHALIC ACID, HAVING AN EXTREMELY HIGH ABSORBABILITY FOR WATER AND PHYSIOLOGICAL LIQUIDS

This application is a continuation of application Ser. No. 597,104, filed Apr. 2, 1984, now abandoned.

BACKGROUND OF THE INVENTION

The invention concerns not only a process for the production of water-insoluble fibers of cellulose monoesters of maleic acid, succinic acid and phthalic acid, with an extremely high absorbability for water and physiological liquids, but also the fibers themselves.

There exists as before a need for water-insoluble fiber articles with improved absorbability in the areas of hygene, medicine, house keeping, clothing and technology. In particular it is desired that such special fibers are capable of being worked up with customary machines and production apparatus, which presupposes certain minimal values with regard to fiber strength and fiber elongation.

Hydrophilically modified viscous fibers are known under the commercial name Viscosorb (Lenzinger Berichte, Volume 51 (1981), pages 34 et seq.). Their water-retaining ability from 140 to 150% or 200 to 210% is indeed not an inconsiderable increase over normal viscose (80–90%). There appears, however, still a need for improvement.

Tolerable water-insoluble cross-polymerized fiber-shaped salts of carboxymethyl cellulose are known from DT-OS 19 12 740. They can display a water-retention value of more than above 300%. Indeed for these fiber-shaped salts to be only 5–16% soluble, the fiber-shaped water-soluble NaCMC-salts usually produced from cellulose must be cross-linked with epichlorohydrine or formaldehyde. The fiber-shaped condition of the final product results in other respects solely from the pre-given short fiber shape of the cellulose that is to be reacted chemically, which generally displays an average fiber length from 1–2.4 mm. The production of normal endless filaments with the aimed-for mechanical characteristics is naturally not possible in this manner.

Also known are cellulose acetophthalates, which are obtained from hydrolyzed cellulose acetate and an excess of phthalic acid anhydride in acetone or dioxane (Ullmann, First Edition, Volume 9, page 237). Herewith are produced esters of phthalic acid with a free carboxyl group. These products are suitable as water- or alkali-soluble textile finishings and are also employed as antistaticums in the coating of films.

The present invention is based upon the object of preparing new water-insoluble fibers, which particularly based upon their high and extremely variable absorbability for water and physiological liquids represents an interesting enrichment to the state of the art.

SUMMARY OF THE INVENTION

Initially, the subject of the present invention involves a process for the production of water-insoluble fibers from cellulose monoesters of maleic acid, succinic acid, and phthalic acid with an extremely high absorption ability for water and physiological liquids, which is thereby characterized in that (a) at a temperature from 20° to 80° C., a solution of activated cellulose in dimethylacetamide or 1-methyl-2- pyrrolidon is prepared, which contains 5 to 30% by weight activated cellulose having an average degree of polymerization from 300 to 800 and 3 to 20% by weight LiCl, (b) the so-dissolved cellulose is reacted with the corresponding dicarboxylic acid anhydrides in a mol ratio from 1:0.20 up to 1:4, at 20° to 120° C. in the presence of known esterification catalysts until a degree of esterification of at least 0.1–1.7, (c) the obtained cellulose monoester solution is spun by means of wet spinning into a coagulation agent and (d) the fibers of cellulose monoesters of phthalic acid and, if necessary, those of cellulose monoesters of maleic acid and succinic acid, are converted in a substantially organic solvent by means of reacting with alkali metal hydroxides, alkali metal alcoholates, ammonia or primary or secondary amines, partially or completely into the corresponding fiber-shaped salts.

The production of the LiCl-containing solutions of activated cellulose in dimethylacetamide or 1-methyl-2-pyrrolidon is known from DT-OS 30 270 33. This literature reference describes several process variations for activation of the cellulose and for production of the mentioned solutions.

Obtaining the water-insoluble fibers of the abovedescribed type with an extremely high absorption ability for water and physiological liquids is dependent upon which are influenced differently by the constitution of the particular macromolecular material. It is initially essential for obtaning fibers with satisfactory mechanical characteristics that a sufficiently high degree of polymerization be guaranteed. It is therefore essential that the initially prepared activated cellulose display an average degree of polymerization from 300 to 800, preferably from 350–650, which must be extensively maintained upon the reaction with dicarboxylic acid anhydrides. In order to avoid a degradation of the cellulose, reaction temperature and reaction periods must be adjusted with each other. For the working up of higher concentrated cellulose solutions (15–30% by weight) at temperatures up to 120° C. and brief dwell periods (e.g. 5 minutes) extruders or continuous kneaders are suggested. Reaction temperatures from 40° to 100° C. have proven to be particularly advantageous for the reaction of the activated cellulos into cellulose monoesters.

As known esterification catalysts, various acids are suitable for the esterification reaction, such as methane sulfonic acid, perchloric acid, formic acid, and sulfuric acid, or acid chlorides, such as acetylchloride and propionylchloride. These acid esterification catalysts can be employed in amounts from about 2 to 10% by weight, relative to the amount of acid anyhydride.

However, also basic esterification catalysts are well suitable for the esterification reactions involved, especially those opposing a degradation of the cellulose. By way of example, the following tertiary amines may be mentioned: 4-N,N-dimethylaminopyridine, collidin, pyridine and triethylamine. Such basic esterification catalysts are added, relative to the acid anhydride in equimolar amounts, in order to bind the acids freed upon the reaction. The fiber-shaped quaternary ammonium salts obtained herewith after the spinning can easily be converted into alkali methyl salts or into secondary or tertiary ammonium salts according to methods described further below.

Suitable as esterification catalysts are, in particular, basic salts of monocarboxylic acids, such as sodium acetate, potassium acetate, sodium propionate, potassium propionate, sodium butyrate and potassium butyrate. Generally, the salts are employed in amounts from 2 to 10% by weight, preferably from 5 to 10% by weight, relative to the active anhydrides. It has proven to be particularly advantageous to use alkali metal acetates in amounts from 2 to 10% by weight, relative to the employed dicarboxylic acid anhydride.

Upon synthesis of the fibers according to the present invention, a developed relation is to be observed between the absorption ability for water and physiological liquid and the constitution of the macromolecules which depends on the other hand upon the degree of esterification of the cellulose (DS), whether or not the involved cellulose monoester is provided completely or partially in the form of alkali metal salts.

The absorptionability for water and physiological liquids is set forth below by means of the parameters water retention ability (WRV) and retention ability for synthetic urines (SURV).

The water retention ability according to German industrial requirements DIN 53 814 is a measure for the water retained in the individual fibers after full immersion in water and subsequent defined shaking off. The same applies for the retaining ability of synthetic urines, which is measured according to the same requirement.

Thus the cellulose monoester fibers of maleic acid, in which the hydroxyl hydrogen of the carboxyl group is not substituted by an alkali metal, display a high water retaining ability (WPV), when their degree of esterification amounts to between about 0.4 and 1.3. The WRV-valve amounts to about 200% with a degree of esterification (DS) of 0.4. It runs with a DS of approximately 0.7 with a WRV-value of 1100%, to a maximum, rising then to a degree of esterification of 1.2, falling back again to a WRV-value of 250%, whereby with still higher degrees of esterification the WRV-value drops further. Correspondingly, the production of non-neutralized cellulose monoester fibers of maleic acid with a degree of esterification from 0.4 to 1.3 is a preferred embodiment of the present invention. The pH-value of such fibers lies outside of the alkaline range, which is essential in each case for the use in the areas of hygron and medicine.

The cellulose monoester fibers of succinic acid, in which the hydroxyl hydrogen of the carboxyl group is not partially or completely replaced by an alkali metal, display indeed with a degree of esterification of about 0.3 a good water retaining ability of 220%. The WRV-value rises from there in surprising manner so steeply that, with a DS of 0.67, the water retaining ability already amounts to nearly 5300%. This astonishingly high WRV-value drops again with higher degrees of esterification. It reaches with a DS of 1.7, 1900%. The production of non-neutralized, thus not provided in salt form, cellulose monoester fibers of succinic acid with a degree of esterification from 0.3 to 1.7 is, appropriately, a further preferred embodiment of the present invention.

The cellulose monoester fibers of phthalic acid, in which the hydroxyl hydrogen of the carboxyl group are not partially or completely replaced by an alkali metal, display with lower degrees of esterification a relatively low WRV-value, e.g. with a DS of 0.20 a WRV-value of 125%, which decreases further with rising DS values. A considerable increase in water-retaining ability is provided with such fibers according to the present invention by converting them in a substantially organic solvent by means of reaction with alkali metal hydroxide, alkali methyl alcoholates, ammonia or primary or secondary amines into the corresponding fiber-shaped salts.

Suitable for the conversion of the cellulose monoester fibers are, in particular, alcoholic alkali metal hydroxide solutions, which are prepared by dissolving NaOH, KOH, LiOH or $NH_3$ in the appropriate alcohols, such as methanols, ethanol, propanol and butanol, if necessary with small amounts of water. The neutralization should follow herewith a temperature from 10° to 25° C. In addition, the corresponding bicarbonate or carbonate, in connection with small additions of water to the employed alcohols, can be used for this purpose. Mainly suitable for the conversion are also primary or secondary amines, such as e.g. diethylamine, propylamine and ethanolamine. In the event that other organic solvents are used, such as e.g. acetone or dioxane, these should likewise have added small additions of water as dissolving agent, as a rule about 10 to 30% by weight. In other respects the best suitable amount of water addition can be easily determined by the skilled man of the art by simple testing, since they are upwardly limited only by the water swelling ability of the fibers involved, which on the other hand depends upon the degree of esterification.

Substantially completely neutralized water-insoluble cellulose monoester fibers of phthalic acid with an extremely high absorption ability for water and physiological liquids can be prepared in the described manner only in the narrowly limited degree of esterification range from 0.1 to 0.4. Upon the production of sodium or ammonium salts of cellulose monoesters of phthalic acid, the WRV-value rises from 100 up to about 4000%. With higher degrees of esterification, the fibers are water-soluble.

In analogous manner, also water-insoluble fibers can be produced from the acid cellulose monoester fibers of maleic acid and succinic acid by complete neutralization of the carboxylic groups with alkali metal salts, their water retaining ability amounting to a multiple of that of the corresponding acid cellulose monoester fibers. Here, too, the producability of such fibers is linked to the narrowly limited degree of esterification range from 0.1 up to 0.4. Above a degree of esterification of about 0.4, the fibers lose the desired characteristic of being water-insoluble. The production of substantially neutralized cellulose monoester fibers of maleic acid, succinic acid, and phthalic acid, which display a degree of esterification from 0.1 up to 0.4, represents a further preferred embodiment of the present invention. Such fibers can advantageously be employed for the production of absorbable surface structures, such as swaddles, cleaning rags, dish cloths and vapor filters.

It is also possible according to the present invention to neutralize the initially prepared acid cellulose monoester fibers of maleic acid, succinic acid and phthalic acid, only partially. In this manner the aimed-for magnitude of water retaining ability can be varied in the specifically desired direction since the WRV-value of such partially neutralized fibers lies between those of unneutralized and completely neutralized cellulose monoester fibers. Indeed according to choice of the correspondingly smaller, greater or medium degrees of neutralization, one can therefore optionally approximate, on the one hand, the acid cellulose monoester fibers or the cellulose monoester fibers provided completely in alkali metal salt form, with regard to the swelling capacity, or, on the other hand, be maximally removed from these types of fiber. In this manner it is indeed possible in principle, still with degrees of esterification of above 0.4 and up to 1.7, to obtain water-insoluble fibers of a high water absorption ability, although this may not be so advantageous as a rule on economical grounds as the production of the above-described preferred embodiments.

The fibers according to the present invention display in conditioned state, fiber strength from 4–20 cN/tex, preferably 6–15 cN/tex, elongation from 4–20%, preferably 6–16%, and a water retaining ability of greater than 200%, preferably greater than 300%, which generally can be increased in the described manner up to a WRV-value of several thousand percent.

In addition to the extremely high absorption ability for water and physiological liquids, water-insoluble fibers according to the present invention display also an increased water-sorbing ability (WSV). This is measured in the socalled Demand-Wettability-Test (Bernard M. Lichstein, INDA, 2nd Annual Symposium on Non-woven Products Developments, March 5th and 6th 1974, Washington, D.C.), which, as a very use-relative test, determines the average absorption speed and the absorption capacity of an absorbing material under determined support pressure, whereby the measuring liquid itself exerts no pressure on the sample.

In other respects the fibers according to the present invention of cellulose monoesters of maleic acid, succinic acid and phthalic acid are spun according to customary wet spinning techniques and with customary apparatus. Upon wet spinning, the appropriately prepared cellulose monoester solution is pressed out through nozzles with fine bores into a suitable coagulation bath, for example an alcohol bath maintained at room temperature. Well suitable coagulation agents are, for example, the alcohols methanol, ethanol, propanol and butanol, ketones, such as dimethylketone, methylethylketone, diethylketone, dipropylketone and dibutylketone, and ethers, such as dipropylether, dibutylether, diisoamylether and dioxane. With the spinning of cellulose monoesters having WRV-value lying below 200%, even a water bath can serve as coagulation bath, since these fibers in unneutralized state possess a relatively small water swelling ability. The development of maximal fiber characteristics can be sustained by introducing the fibers, combined into a spinning table, into a series of wash baths, which contain the above-mentioned solvent and, if necessary inorganic salts, in order to remove the remainder of the employed solvents and LiCl. Simultaneously, a stretching can be connected with the aftertreatment, which permits an adjustment of the particularly desired fiber characteristics. The stretching ratio can be varied therewith from between 1:1 and 3:1.

DESCRIPTION OF THE PREFERRED EMBODIMENTS

EXAMPLE 1

In a three-necked flask of volume 1 liter, 16.2 g (0.1 mol) cellulose (DP:650, measured in the solvent Cuen) are suspended in 278.4 g (3.2 mol) technical dimethylacetamide, and activated at 155° C. for a period of thirty minutes. After cooling to 100° C., 29 g (0.68 mol) of LiCl are added. Therewith the temperature rises about 5°–10° C., and then subsequently it is cooled down to room temperature (RT=~20°–25° C.). After 2–3 hours stirring at room temperature, a gel-like cellulose solution is obtained. The solution is stirred further overnight. Therewith arises a clear viscous solution, which is reacted with a mixture of 22.2 g (0.15 mol) phthalic acid anhydride and 1 g (0.01 mol) potassium acetate, initially 5 hours at 40° C. and subsequently 15 hours at room temperature. The reaction mixture is filtered, de-aerated, and spun through a viscose spinning nozzle (36/90) into a precipitation bath of water, followed by washing and drying.

The cellulose monophthalate fibers obtained in this manner displayed the following characteristics:

| | |
|---|---|
| Degree of esterification (DS): | 0.36 |
| Degree of polymerization (DP): | 445 |
| Fiber strength (COND): | 11.8 cN/tex |
| Fiber elongation (COND): | 9.5% |
| Water retaining ability (WRV): | 110% |
| Synthetic urin retaining ability (SURV): | 105% |
| Water absorbing ability according to Demand (WSV): | 410% |

PRODUCTION OF THE SODIUM SALT 6.45 g (0.03 mol) cellulose monophthalic acid ester fibers are suspended in 200 ml methanol, and then reacted with a solution of 1.32 g (0.033 mol) NaOH in 20 ml water. After 30 minutes, the sodium salt is filtered off, washed three times, each time with 100 ml methanol, and then dried.

The fiber-shaped sodium salt of cellulose monophthalate displays the following swelling values:

| | |
|---|---|
| Water retaining ability (WRV): | 3800% |
| Synthetic urin retaining ability (SURV): | 430% |
| Water absorbing ability according to Demand (WSV): | 4000% |

EXAMPLES 2–8

The cellulose monophthalic acid ester set forth in Table 1 is produced in principle according to the same process as described in Example 1. The same applies for its further working up into the claimed salt-form fibers.

TABLE 1

(Cellulose monoester of Phthalic acid)
Reaction temperature: 40–50° C. + RT  Reaction period: 5 h 15 h

| Example | Mol ratio Cellulose | acid anhydride | Catalyst relative to the acid anhydride | DS | DP | WRV (%) | SURV (%) |
|---|---|---|---|---|---|---|---|
| 2 | 1 | 1 | 5% $CH_3SO_3H$ | 0.19 | 364 | 125 | 120 |
| Ammonium salt | | | | | | 600 | 200 |
| 3 | 1 | 1.5 | 5% $CH_3SO_3H$ | 0.33 | 376 | 115 | 110 |

TABLE 1-continued (Cellulose monoester of Phthalic acid)
Reaction temperature: 40–50° C. + RT Reaction period: 5 h 15 h

| Example | Mol ratio Cellulose:acid anhydride | | Catalyst relative to the acid anhydride | DS | DP | WRV (%) | SURV (%) |
|---|---|---|---|---|---|---|---|
| Ammonium salt | | | | | | 3200 | 400 |
| 4 | 1 | 0.25 | 0.25 mol 4-N,N—dimethylaminopyridine | — | — | 1000 | 290 |
| 5 | 1 | 0.50 | 0.50 mol 4-N,N—dimethylaminopyridine | — | 562 | 5100 | 900 |
| 6 | 1 | 0.50 | 0.50 mol triethylamine | — | 540 | 3300 | 1100 |
| 7 | 1 | 0.50 | 0.50 mol collidin | — | 494 | 1700 | 350 |
| 8 | 1 | 1.5 | 0.75 mol lithium-carbonate | 0.40 | — | 4500 | 700 |

EXAMPLE 9

16.2 g (0.1 mol) cellulose are activated in 278.4 g (3.2 mol) technical dimethylacetamide for 30 minutes at 155° C. After cooling down to 100° C., 29 g (0.68 mol) of LiCl are added, and the mixture is stirred overnight. Therewith arises a clear, viscous cellulose solution, which is esterified with a mixture of 19.6 g (0.2 mol) maleic acid anhydride and 1 g (0.01 mol) methane sulfonic acid, initially for 5 hours at 40° C., and subsequently 15 hours more at room temperature. The reaction mixture is filtered, de-aerated, and spun by means of a viscous spinning nozzle (36/90) into an aqueous precipitation bath. Thereafter it is washed and dried.

The obtained cellulose maleinate fibers display the following characteristics:

| | |
|---|---|
| Degree of esterification (DS): | 0.35 |
| Degree of polymerization (DP): | 350 |
| Fiber strength (COND): | 10.6 cN/tex |
| Fiber elongation (COND): | 8.9% |
| Water retaining ability (WRV): | 170% |
| Synthetic urin retaining ability (SURV): | 160% |
| Water absorbing ability according to Demand (WSV): | 390% |

CONVERSION INTO THE SODIUM OR AMMONIUM SALTS 9.6 g (0.05 mol) cellulose monomaleic acid ester fibers are suspended in 200 ml methanol and neutralized with a solution of 2.2 g (0.055 mol) NaOH in 20 ml water. The salt is filtered off, washed three times, each time with 100 ml methanol, and then dried.

In similar manner, the cellulose maleinate fibers are converted into the ammonium salt.

The fiber-shaped cellulose maleinate salts obtained in this manner display the following swelling values:

| | Na-Salt | $NH_4^+$-Salt |
|---|---|---|
| Water retaining ability (WRV): | 1000 | 950% |
| Synthetic urin retaining ability (SURV): | 400% | 350% |
| Water absorbing ability according to Demand (WSV): | 2100% | — |

EXAMPLES 10–17

On the basis of the manner of operation from Example 9 and the reaction conditions in Table 2, the cellulose monoesters of maleic acid are prepared in Examples 10–17, and then spun into fibers. Therewith, with poorly swelling cellulose derivatives (WRV: less than 200%) water, and with strongly swelling cellulose derivatives (WRV: greater than 200%) ethanol, are employed as coagulation agents.

TABLE 2

(Cellulose monoester of Maleic acid)
Reaction temperature: 40–50° C. + RT Reaction period: 5 h 15 h

| Example | Mol ratio Cellulose:acid anhydride | | Catalyst relative to the acid anhydride | DS | DP | WRV (%) | SURV (%) | WSV (%) | fiber strength (cN/tex) | Fiber elongation (%) |
|---|---|---|---|---|---|---|---|---|---|---|
| 10 | 1 | 1.0 | 10% $CH_3COOK$ | 0.25 | 450 | 120 | 110 | 320 | 14.5 | 8.5 |
| 11 | 1 | 1.5 | 5% $CH_3SO_3H$ | 0.32 | 320 | 160 | 150 | 370 | 6.3 | 4.6 |
| 12 | 1 | 1.5 | 6.8% $CH_3COOK$ | 0.57 | 390 | 390 | 280 | 520 | 12.1 | 9.3 |
| 13 | 1 | 2.0 | 5% $CH_3COOK$ | 0.67 | 385 | 1000 | 850 | — | 10.7 | 10.1 |
| 14 | 1 | 2.5 | 5% $CH_3COOK$ | 0.83 | 380 | 840 | 690 | — | 11.3 | 9.6 |
| 15 | 1 | 3.0 | 10% $CH_3COOK$ | 1.18 | — | 300 | 270 | 350 | 8.5 | 6.0 |
| 16 | 1 | 3.5 | 10% $CH_3COOK$ | 1.23 | — | 200 | 190 | 260 | — | — |
| 17 | 1 | 4.0 | 10% $CH_3COOK$ | 1.35 | — | 180 | 170 | 240 | — | — |

EXAMPLE 18 500 g (3.08 mol) cellulose are suspended in 8600 g (98.85 mol) technical dimethylacetamide, and then activated for a period of 30 minutes at 155° C. After cooling down to 100° C., 850 g (20.03 mol) LiCl are added. Upon stirring overnight at room temperature there arises a clear, viscous solution. Successively, 24.6 g (0.25 mol) potassium acetate and 246 g (2.46 mol) succinic acid anhydride, are added to the solution. The reaction mixture is heated at 60° C. for the initial 5 hours, and stirred for 15 hours at room temperature, subsequently filtered, de-aerated, and spun through a viscous spinning nozzle (60/90) into an alcoholic precipitation bath, followed by washing and drying. The cellulose succinate fibers resulting therewith display the following characteristics:

| | |
|---|---|
| Degree of esterification (DS): | 0.67 |
| Degree of polymerization (DP): | 460 |
| Fiber strength (COND): | 8.1 cN/tex |
| Fiber elongation (COND): | 15.7% |
| Water retaining ability (WRV): | 5300% |
| Synthetic urin retaining ability (SURV): | 2000% |

EXAMPLES 19–25

On the basis of the manner of operation from Example 18 and the reaction conditions in Table 3, cellulose monoesters of succinic acid are prepared in Examples 19–25.

TABLE 3

(Cellulose monoester of succinic acid)
Reaction temperature: 60° C. + RT — Reaction period: 5 h + 15 h
Catalyst 10% by weight potassium acetate, relative to the acid anhydride

| Example | Mol ratio Cellulose:acid anhydride | | DS | DP | WRV (%) | SURV (%) |
|---|---|---|---|---|---|---|
| 19 | 1 | 0.5 | 0.45 | 445 | 750 | 350 |
| 20 | 1 | 0.6 | 0.51 | 410 | 1780 | 480 |
| 21 | 1 | 0.8 | 0.65 | 405 | 4000 | 950 |
| 22 | 1 | 1.0 | 0.71 | 400 | 5000 | 1700 |
| 23 | 1 | 2.0 | 0.97 | 375 | 3700 | 960 |
| 24 | 1 | 3.0 | 1.31 | — | 2550 | 940 |
| 25 | 1 | 4.0 | 1.70 | — | 1900 | 930 |

EXAMPLE 26 500 g (3.08 mol) cellulose are activated for 30 minutes at 155° C. in 8600 g (98.85 mol) technical dimethylacetamide. After cooling down to 100° C., 850 g (20.03 mol) LiCl are added thereto. The mixture is stirred overnight at room temperature for the purpose of a complete dissolution of the cellulose. Then, successively 10.8 g (0.11 mol) potassium acetate and 107.8 g (1.08 mol) succinic acid anhydride, are added to the produced solution. The mixture is heated initially for 5 hours at 70° C., then stirred for 15 hours at room temperature, after which it is filtered, de-aerated and spun through a viscous spinning nozzle (60/90) into an alcoholic precipitation bath, followed by washing and drying.

The cellulose succinate fibers manufactured in this manner display the following characteristics:

| | |
|---|---|
| Degree of esterification (DS): | 0.33 |
| Degree of polymerization (DP): | 520 |
| Fiber strength (COND): | 9.8 cN/tex |
| Fiber elongation (COND): | 19.8% |

-continued

| | |
|---|---|
| Fiber strength (wet): | 1.9 cN/tex |
| Fiber elongation (wet): | 26.4% |
| Water retaining ability (WRV): | 280% |
| Synthetic urin retaining ability (SURV): | 170% |
| Water absorbing ability according to Demand (WSV): | 1000% |

PRODUCTION OF THE SODIUM SALTS 19.5 g (0.1 mol) of acid cellulose monosuccinic acid ester fibers are mixed into 300 ml methanol and then neutralized with a solution of 4.4 g (0.11 mol) NaOH in 20 ml water, subsequently filter off, washed three times, each time with 100 ml emthanol, and then dried.

The fiber-shaped sodium salt of cellulose succinic acid ester displays the following characteristics:

| | |
|---|---|
| Fiber strength (COND): | 9.4 cN/tex |
| Fiber elongation (COND): | 19.8% |
| Water retaining ability (WRV): | 3400% |
| Synthetic urin retaining ability (SURV): | 380% |
| Water absorbing ability according to Demand (WSV): | 6400% |

EXAMPLES 27–29

The cellulose monoester of succinic acid set forth in Table 4 are synthesized according to the same technique as set forth in Example 26.

TABLE 4

(Cellulose monoester of succinic acid)
Reaction temperature: 70° C. + RT — Reaction period: 5 h + 15 h
Catalyst 10% by weight potassium acetate, relative to the acid anhydride

| Example | Mol ratio Cellulose:acid anhydride | | DS | WRV (%) | SURV (%) | WSV (%) |
|---|---|---|---|---|---|---|
| 27 | 1 | 0.32 | 0.30 | 220 | 150 | 750 |
| 28 | 1 | 0.38 | 0.35 | 300 | 180 | 1100 |
| 29 | 1 | 0.40 | 0.37 | 370 | 230 | 1400 |

EXAMPLE 30

16.2 g (0.1 mol) cellulose are dissolved in 278.4 g (3.2 mol) technical diemthylacetamide and 29 g (0.68 mol) LiCl. Thereafter are added successively to the cellulose solution, 6.1 g (0.05 mol) 4-N,N-dimethylaminopy ridine and 5 g (0.05 mol) succinic acid anhydride. The mixture is initially heated for 5 hours at 40° C., then stirred for 15 hours at room temperature, and subsequently precipitated with ethanol, washed and then dried.

The short-fiber cellulose monoester of succinic acid prepared in this manner displays the following characteristics.

| | |
|---|---|
| Degree of polymerization (DP): | 555 |
| Water retaining ability (WRV): | 3600% |
| Synthetic urin retaining ability (SURV): | 950% |

EXAMPLES 31–33

On the basis of the manner of operation from Example 30 and the reaction conditions of Table 5, the cellulose monoester of succinic acid set forth therein is synthesized.

TABLE 5

(Cellulose monoester of succinic acid)
Reaction temperature: 40° C. + RT Reaction period: 5 h 15 h

| Example | Mol ratio cellulose:acid anhydride | | Catalyst relative to the acid anhydride | DS | DP | WRV (%) | SURV (%) |
|---|---|---|---|---|---|---|---|
| 31 | 1 | 0.20 | 0.20 Mol 4-N,N—dimethyl-aminopyridine | — | 575 | 900 | 200 |
| 32 | 1 | 0.40 | 0.40 Mol triethylamine | — | 560 | 2700 | 850 |
| 33 | 1 | 1.50 | 10% $CH_3SO_3H$ | 0.20 | 345 | 160 | 120 |

EXAMPLE 34

200 g (1.234 mol) cellulose are dissolved in 2100 g (24.13 mol) technical dimethylacetamide and 200 g (4.71 mol) LiCl. The cellulose solution is supplemented by 6.1 g (0.06 mol) potassium acetate and 61.8 g (0.62 mol) succinic acid anhydride, and the mixture is subsequently homogenized. The esterification follows in a Werner-Pfleiderer-double screw extruder at 100° C. during a dwell period of 5 minutes. Simultaneously, the reaction mixture is concentrated by means of an applied vacuum to 40% moisture content. By means of introduction into methanol, the cellulose ester is then precipitated, followed by washing with methanol, and then drying.

The cellulose ester obtained in this manner displays a degree of esterification of 0.28.

It will be understood that each of the elements described above, or two or more together, may also find a useful application in other types of fibers differing from the types described above.

While the invention has been illustrated and described as embodied in water-insoluble fibers of cellulose monoesters of maleic acid, succinic acid and phthalic acid, having an extremely high absorbability for water and physiological liquids, and process for the production thereof, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims.

1. Process for the production of water-insoluble fibers of cellulose monoesters of maleic acid, succinic acid or phthalic acid having an extremely high absorption ability of water and physiological liquids, comprising, in order:

(a) preparing a solution of activated cellulose in dimethylacetamide or 1-methyl-3-pyrrolidon, (b) reacting the so-dissolved cellulose while extensively maintaining average degree of polymerization of 300–800, with a dicarboxylic acid anhydride in a mol ratio from 1 : 0.20 up to 1 : 4 at 20° to 120° C. and in the presence of a known esterification catalyst, over a period from 5 minutes to 20 hours to obtain a degree of esterification, (c) spinning the obtained cellulose monoester solution by means of wet spinning into a coagulation agent to form water-insoluble fibers of cellulose monoesters of maleic acid, succinic acid, or phthalic acid, and converting said fibers partially or completely into corresponding fiber-shaped salts of the cellulose monoesters of phthalic acid, maleic acid, or succinic acid in a substantially organic solvent by reaction with alkali metal hydroxide and/or alkali metal alcoholate or ammonia or primary or secondary amine.

2. Process according to claim 1, wherein said preparing the solution of activated cellulose is performed at a temperature from 20° to 80° C.

3. Process aocording to claim 1, wherein said reacting of the activated cellulose into cellulose monoester takes place at a reaction temperature from 40° to 100° C.

4. Process according to claim 1, employing as catalyst alkali metal acetate in amounts from 2 to 10% by weight, relative to the employed dicarboxylic acid anhydride.

5. Process according to claim 1, wherein such cellulose monoester fibers of maleic acid, succinic acid, or phthalic acid which are converted into fiber-shaped salts display a degree of esterification from 0.1 to 0.4.

6. Process according to claim 5, wherein the fibers are converted by substantially completely neutralizing with alcoholic alkali metal hydroxide solution at a temperature between 10° and 25° C.

7. Process according to claim 1, wherein said prepared solution contains 5 to 30% by weight activated cellulose,

8. Process according to claim 1, wherein said prepared a solution contains 3 to 20% by weight LiCl.

9. Proqess according to claim 1, wherein said prepared solution has average degree of polymerization from 300 to 800.

10. Process according to claim 1, wherein the reacting is effected to a degree of esterification of at least 0.1 to 1.7.

11. Process for the production of water-insoluble fibers of cellulose monoesters of maleic acid or succinic acid having an extremely high absorption ability for water and physiological liquids, comprising, in order:

(a) preparing a solution of activated cellulose in dimethylacetamide or 1-methyl-3-pyrrolidon, (b) reacting the so-dissolved cellulose while extensively maintaining average degree of polymerization of 300–800, with a dicarboxylic acid anhydride in a mol ratio from 1 : 0.20 up to 1:4 at 20° to 120° C. and in the presence of a known esterification catalyst, over a period from 5 minutes to 20 hours to obtain a degree of esterification of from 0.4 to 1.3 for a monoester solution of maleic acid, or a degree of esterification of from 0.3 to b 1. 7 for a monoester solution of succinic acid, (c) spinning the obtained cellulose monoester solution by means of wet spinning into a coagulation agent to form water-insoluble fibers of cellulose monoesters of maleic acid or succinic acid, without any subsequent neutralization of the obtained fibers.

* * * * *